US006510641B1

(12) United States Patent
Viani

(10) Patent No.: US 6,510,641 B1
(45) Date of Patent: Jan. 28, 2003

(54) TRIGGER AND FIRING PIN LOCKING SYSTEM

(76) Inventor: Arthur Viani, 12219 SW. 131 Ave., Miami, FL (US) 33186

( * ) Notice: Subject to any disclaimer, the term of this patent is extended or adjusted under 35 U.S.C. 154(b) by 0 days.

(21) Appl. No.: 09/978,712

(22) Filed: Oct. 16, 2001

Related U.S. Application Data

(63) Continuation-in-part of application No. 09/662,578, filed on Sep. 15, 2000.

(51) Int. Cl.[7] ..... F41A 17/02
(52) U.S. Cl. ..... 42/70.08; 42/70.11
(58) Field of Search ..... 42/1.01, 70.01, 42/70.08, 70.11; 89/18, 148, 174

(56) References Cited

U.S. PATENT DOCUMENTS 1,842,847 A * 1/1932 Stange ..... 42/70.01
4,672,762 A * 6/1987 Nilsson ..... 42/16
6,338,217 B1 * 1/2002 Viani ..... 42/70.08
6,357,155 B1 * 3/2002 Amadini ..... 42/70.08
6,363,646 B1 * 4/2002 Amadini ..... 42/70.08

* cited by examiner

*Primary Examiner*—Michael J. Carone
*Assistant Examiner*—Gabriel Sukman
(74) *Attorney, Agent, or Firm*—J. Sanchelima; A. Bordas

(57) ABSTRACT

A firing pin locking mechanism that can be used on firearms. Controlled by a key, the internal locking device blocks all movement of the firing pin assembly striker, preventing the firing arm from discharging. The mechanism primarily comprises a striker-locking guide, key plate assembly, key, and decocking button. Utilizing the key, the authorized user has the ability to set the firearm in a "unlocked" or "locked" mode. The internal locking mechanism is utilized as a means to prevent the movement of a firearm's firing pin assembly when activated by the trigger mechanism. The present invention is primarily utilized with semi-automatic firearms that have an enclosed striker assembly.

6 Claims, 3 Drawing Sheets

TRIGGER AND FIRING PIN LOCKING SYSTEM

OTHER RELATED APPLICATIONS

The present application is a continuation-in-part of pending U.S. patent application Ser. No. 09/662,578, filed on Sep. 15, 2000, which is hereby incorporated by reference.

BACKGROUND OF THE INVENTION

1. Field of the Invention

The present invention relates to a turnkey locking mechanism for firearms, and more particularly, to an internal locking mechanism for firearms with a firing pin assembly.

2. Description of the Related Art

Firearms can be very dangerous. There is a need for a practical and inexpensive assembly that can be incorporated into firearms, without major structural changes, to lock a firearm when not cocked.

Applicant believes that the closest reference corresponds to applicant's own above referenced patent application. The present application, however, includes subject matter not disclosed in the parent application, such as the locking sleeve assembly with additional cutouts to accommodate an alternate firing pin shape. These improvements are desirable since they solve the problem of locking firearms with an alternate firing pin shape.

SUMMARY OF THE INVENTION

An internal locking mechanism for firearms having an enclosed striker assembly, comprising a striker locking guide having first and second ends. Between the first and second ends there are first and second longitudinal channels. The first end includes a first recess. The first longitudinal channel extended from a first predetermined distance from said first end towards said second end a second predetermined distance without reaching said second end. The first longitudinal channel has third and fourth ends and includes a first notch extending a third predetermined distance from said third end towards said fourth end a fourth predetermined distance. The second longitudinal channel extends from a fifth predetermined distance from said first end towards said second end a sixth predetermined distance without reaching said second end. The second longitudinal channel has fifth and sixth ends and includes a second and third notch. The second notch extends a seventh predetermined distance from said fifth end towards said sixth end without reaching said sixth end. The third notch extends an eighth predetermined distance from said second notch to said sixth end a ninth predetermined distance. The second end has a fourth notch. The first end of said striker-locking guide has at least one indicating mark.

In addition, a firing pin assembly has a shaft with seventh and eighth ends. The shaft has a first leg extending radially outwardly a tenth predetermined distance and a second leg extending radially outwardly an eleventh predetermined distance. The seventh end including a firing pin, said firing pin assembly further includes a stopper surface mounted at a twelfth predetermined distance from said seventh end without reaching said eighth end and a spring member partially housing said shaft. The spring member includes ninth and tenth ends whereby the ninth end coacts against said second end that in turn coacts with said first and second legs, keeping said spring biased towards said second end. The second end has cooperative dimensions to coact with said spring and selectively causing said spring member to compress against said stopper surface.

In addition, the instant invention includes a key plate assembly having inner and outer walls. The key plate assembly has a first through opening. The inner wall including a second recess with mating cooperative characteristics to receive said first end of said striker locking guide, and rotational means for rotating said striker locking guide through said first through opening so that said first and second legs are selectively brought in alignment with said first and third notches respectively, thereby restricting the travel of said shaft, and in alignment with said first and second longitudinal channels respectively having unobstructed travel that permits the operation of said firearm. The rotational means includes a key, insertable through said first through opening of said key plate assembly to said first recess, so that a user exerting a rotational force, rotates said striker locking guide selectively from an unlocked position to a locked position and vice-a-versa. The key plate assembly also has a second through opening to allow for visual identification of said indicating mark. The indicating mark may be of tritium or a similar element. The second recess has at least one protrusion axially mounted thereon having mating cooperative characteristics with said first recess to provide notice when said user rotates said striker locking guide selectively from an unlocked position to a locked position and vice-a-versa.

It is therefore one of the main objects of the present invention to provide an internal locking mechanism utilized with semi-automatic firearms that have an enclosed striker assembly.

It is another object of the present invention to provide an internal locking mechanism that includes a key to set the firearm in a "unlocked" or "locked" mode.

It is another object of this invention to provide a locking mechanism for firearms that includes a key, an internal locking device and a slide cover key plate.

It is still another object of this invention to provide a locking mechanism for firearms in which the internal locking mechanism is utilized as a means to prevent the movement of a firearm firing pin assembly when activated by the trigger mechanism.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
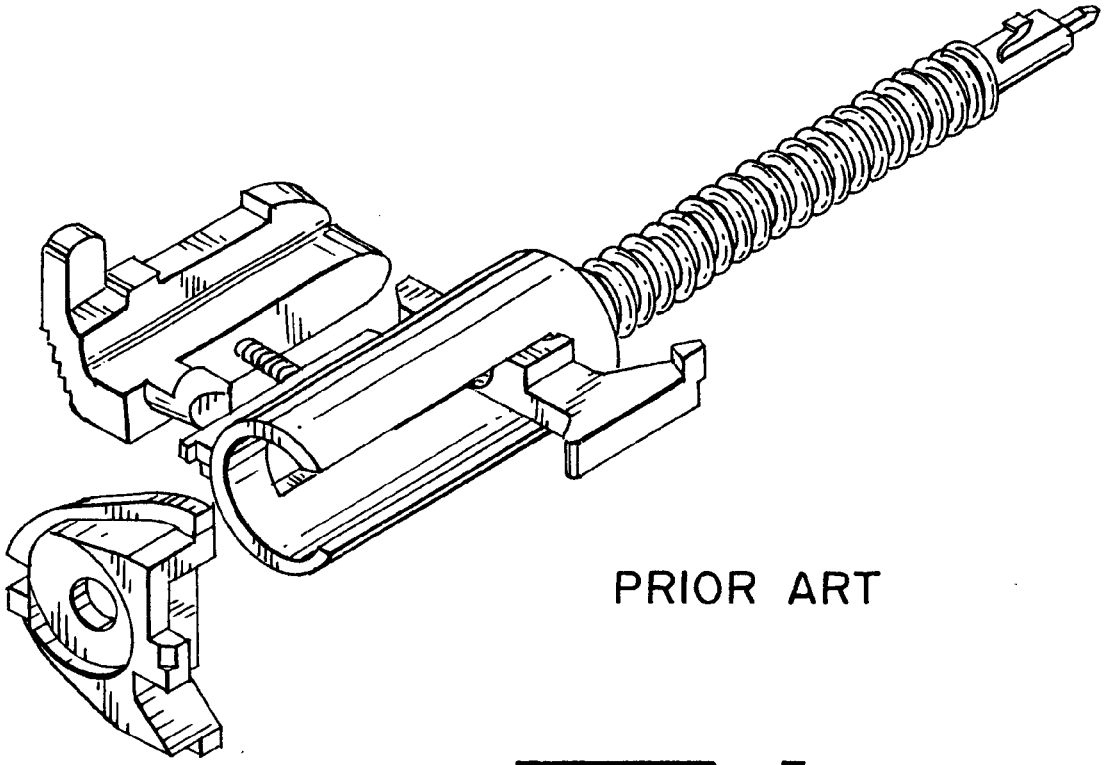
PRIOR ART Fig. 1
FIG. 1 represents the prior art firing pin assembly partially housed within a striker locking guide, a slide end cap and a decocking button.

Referring now to the drawings, where the present invention is generally referred to with numeral 10, it can be observed that it basically includes striker locking guide 30, key plate assembly 60, key 80, and decocking button 90.

Seen in FIG. 1 is a striker locking guide for a striker fired pistol, a slide end cap and a decocking button, as produced for a "SW 99" model, manufactured by Smith & Wesson, located in Springfield, Mass.

Figure 2:
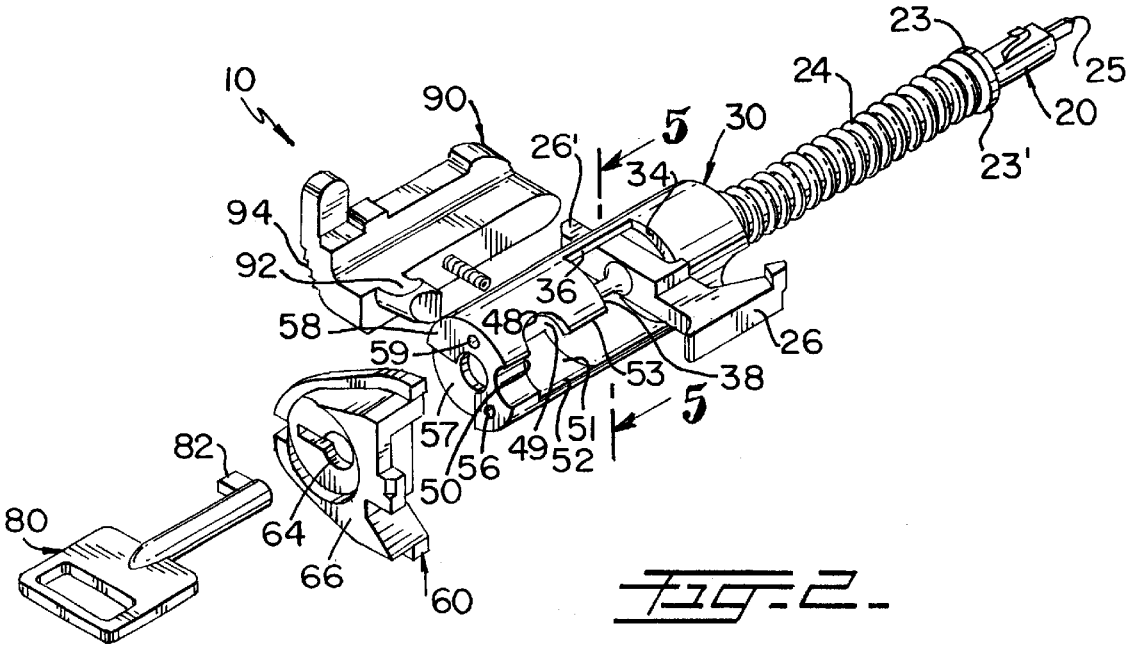
FIG. 2 represents an exploded view of the internal locking mechanism in the unlocked position.
Figure 4:
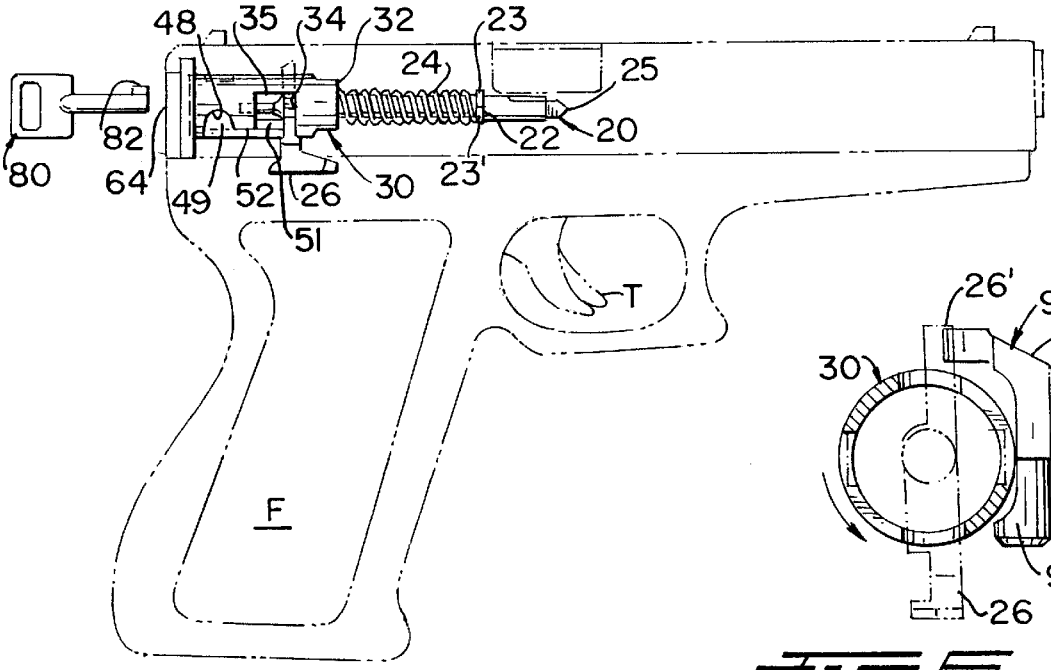
FIG. 4 illustrates an elevational view of a firearm in phantom showing the present invention in the decocked and unlocked position.
Figure 5:
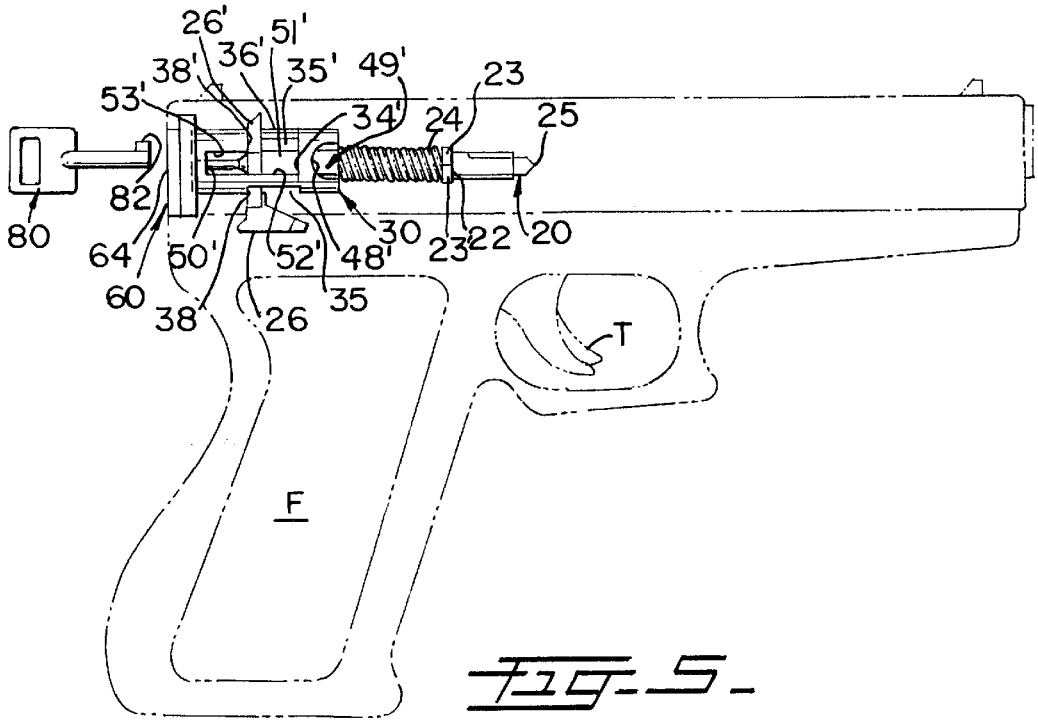
FIG. 5 illustrates an elevational view of a firearm in phantom showing the present invention in the locked position after the firearm has cycled.

As seen, in FIG. 2, firing pin assembly 20 slidably journals within longitudinal channels 51 and 51', seen in FIGS. 4 and 5 respectively, of striker locking guide 30 when in the unlocked position, as seen in FIG. 2. Longitudinal channel 51 has locked channel 35, seen in FIG. 4, and assembly channel 49. Locked channel 35 is defined by side edge 36 establishing a parallel and spaced apart relationship between front edge 34 and rear edge 38 in the preferred embodiment. While firing pin leg 26 fills notch 35 in the decocked position, firing pin leg 26 is biased against front edge 34 due to the spring force exerted by spring 24 against edge 32, seen in FIG. 4. Extending from rear edge 38 towards assembly notch 49, is longitudinal edge 53. Assembly notch 49 allows for assembly of firing pin assembly 20 onto striker locking guide 30. To insert firing pin assembly 20 within striker locking guide 30, end 25 of firing pin assembly 20 is inserted at a predetermined angle along longitudinal channel 51, against edge 48' of assembly channel 49', seen in FIG. 5. Firing pin assembly 20 is installed without spring 24 and spring cups 23 and 23'. Firing pin leg 26' is respectively aligned with assembly notch 49, defined by edge 48. Once received by striker locking guide 30, firing pin leg 26 is slid against front edge 34 where spring 24 is placed over end 25 and retained by spring cups 23 and 23' against stopper surface 22, seen in FIG. 4.

Cylindrical striker locking guide 30 is manufactured from a durable rigid material such as stainless steel, or a material of similar characteristics.

Figure 3A:
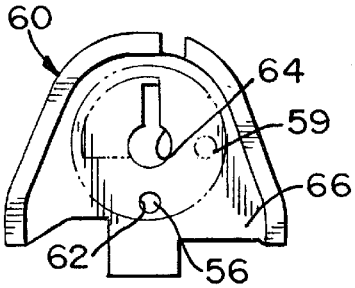
FIG. 3*a* shows an elevational view of the slide cover key plate indicating the firearm is in the unlocked mode.
Figure 3B:
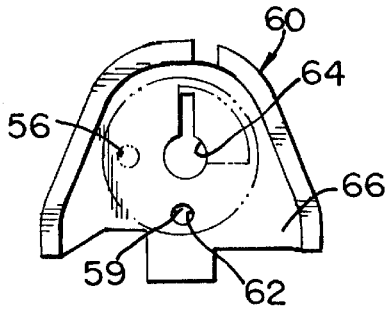
FIG. 3*b* shows an elevational view of the slide cover key plate indicating the firearm is in locked mode.
Figure 3C:
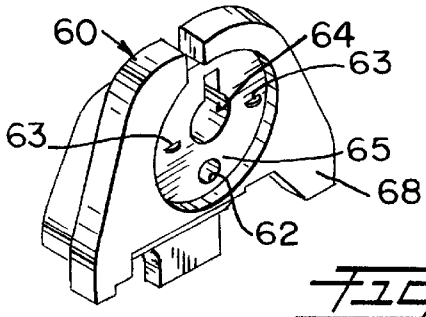
FIG. 3*c* shows a perspective view of the rear side of the slide cover key plate.

Key plate assembly 60 has exterior face 66 and interior face 68, seen in FIG. 3c. Keyhole 64 allows access for an authorized user to trespass key plate assembly 60 with key 80. Key end 82 cooperatively fits into recess 57 of rear exterior surface 58. Through hole 62, seen in FIGS. **3*a*–3*c*, provides notice when indicator 56 is properly aligned, indicating that the firearm is ready to discharge, as depicted in FIG. 3*a*. Through hole 62, provides notice when indicator 59 is properly aligned, indicating that the firearm is locked and will not discharge, as depicted in FIG. 3*b*. Additionally, indicators 56 and 59** are illuminating inserts that allow for visual checking under low light conditions. Such illuminating inserts may be of tritium or other elements of similar characteristics.

While in the unlocked position, as presently depicted, firing pin leg 26 slidably journals within striker locking guide 30 biased against longitudinal edge 52. During operation of the firearm, firing pin leg 26 slidably journals along longitudinal channel 51, thus cycling between front edge 34 after the firearm is discharged to a predetermined distance approaching rear edge 50 when cycled.

Key 80 has key end 82. Key end 82 may be of any shape or design to complement recess 57 of striker locking guide 30.

Seen in FIG. **3*a* is a representation of slide cover key plate assembly 60 in the unlocked position, as represented in FIG. 2. Indicator 56, seen through through-hole 62 is of sufficient contrast to exterior face 66, to allow an authorized user to visually determine that firearm F, seen in FIG. 4, is ready to discharge. Keyhole 64 allows access of key 80, shown in FIG. 2**.

Seen in FIG. **3*b* is a representation of slide cover key plate assembly 60 in the locked position, as represented in FIG. 5. Indicator 59, seen through through-hole 62 is of sufficient contrast to exterior face 66, to allow an authorized user to visually determine that firearm F, seen in FIG. 5, is locked and will not discharge. Keyhole 64 allows access of key 80, shown in FIG. 2**.

Seen in FIG. **3*c* is a representation of the rear side of key plate assembly 60. Interior face 68 has recess 65 shaped to cooperatively receive rear exterior surface 58 of striker locking guide 30, seen in FIG. 2. Recess 65 has protrusions 63 axially mounted thereon having mating cooperative characteristics with recess 57 to provide notice to the user by way of a resistance when the user rotates striker locking guide 30 selectively from an unlocked position, as seen in FIG. 3*a*, to a locked position, as seen in FIG. 3*b***, and vice-a-versa.

As seen in FIG. 4, firearm F is in the unlocked mode. When firearm F is in the unlocked mode, firing pin leg 26 slidably journals within striker locking guide 30 along longitudinal channel 51, biased against longitudinal edge 52. To place in the unlocked position, the user inserts key 80, then turns in a counterclockwise direction, thereby rotating striker locking guide 30 to an unlocked position, thereby allowing for the movement of firing pin assembly 20 when activated by trigger T of firearm F. To remove key 80, the user turns the key in a clockwise direction until key end 82 is aligned with keyhole 64 and removed. The user may acknowledge the unlocked mode of firearm F, by viewing indicator 56 through through-hole 62 as seen in FIG. **3*a***.

As seen in FIG. 5, firearm F is in the locked mode. To place firearm F in the locked mode when firearm F is cocked, surface 94 of decocking button 90, seen in FIG. 6, must first be pressed to decock firearm F. Once firearm F is decocked, an authorized user utilizes key 80, inserting it into keyhole 64 of key plate assembly 60. Key 80 is shaped to cooperatively fit into recess 57, seen in FIG. 2, of striker locking guide 30. The user inserts key 80, then turns in a clockwise direction, thereby rotating striker locking guide 30 to a locked position wherefore firing pin assembly leg 26 rests in notch 35, upon side edge 36 and biased against front edge 34, thereby preventing the movement of firing pin assembly 20 when activated by trigger T of firearm F. To remove key 80, the user turns the key in a counter-clockwise direction until key end 82 is aligned with keyhole 64 and removed. The user may acknowledge the locked mode of firearm F, by viewing indicator 59 through through-hole 62 as seen in FIG. **3*b*. Firearm F, is in the locked mode as shown, whereby firing pin legs 26 and 26' are biased against rear edges 38 and 38'** respectively.

As previously mentioned firing pin assembly 20 slidably journals within longitudinal channels 51 and 51' of striker locking guide 30 when firearm F is in the unlocked mode. While in the unlocked position, as seen in FIG. 4, firing pin leg 26' slidably journals within striker locking guide 30 biased against longitudinal edge 52'. During operation of the firearm, firing pin leg 26' slidably journals along longitudinal channel 51', defined by rear edge 50' establishing a spaced apart relationship between longitudinal edges 52' and 53' in the preferred embodiment. Firing pin leg 26' thus cycling between front edge 34' after the firearm is discharged to a predetermined distance approaching rear edge 50'.

Longitudinal channel 51' has locked channel 35' to receive firing pin leg 26' simultaneously as locked channel 35 receives firing pin leg 26, as seen in FIG. 4. Locked channel 35' is defined by side edge 36' establishing a parallel and spaced apart relationship between front edge 34' and rear edge 38' in the preferred embodiment. While firing pin leg 26' fills locked channel 35' in the decocked and locked position, firing pin leg 26' is biased against front edge 34' due to the spring force exerted by spring 24 against edge 32, seen in FIG. 4. In the decocked and locked position, firing pin assembly leg 26' rests in locked channel 35', upon side edge 36', biased against front edge 34', thereby preventing the movement of firing pin assembly 20 when activated by trigger T of firearm F. The authorized user may then cycle firearm F, achieving the locked mode as shown whereby firing pin leg 26' is biased against rear edge 38'.

Striker locking guide 30 also has assembly notch 49', which allows for assembly of firing pin assembly 20 onto striker locking guide 30. To insert firing pin assembly 20 within striker locking guide 30, end 25 of firing pin assembly 20 is inserted at a predetermined angle along longitudinal channel 51, against edge 48' of assembly channel 49'. Firing pin assembly 20 is installed without spring 24 and spring cups 23 and 23'. Firing pin leg 26' is respectively aligned with assembly notch 49, defined by edge 48, seen in FIG. 4. Once received by striker locking guide 30, firing pin leg 26' is slid against front edge 34' where spring 24 is placed over end 25 and retained by spring cups 23 and 23' against stopper surface 22, seen in FIG. 4.

Firearm F may be of any variety of semi-automatic firearms that have an enclosed striker assembly. Such a firearm may be a "SMITH & WESSON", without limitation to this specific brand.

Figure 6:
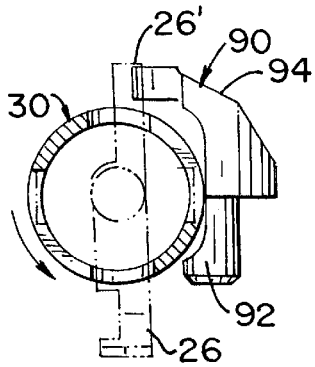
FIG. 6 illustrates an elevational front view of the striker-locking guide rotating against the decocking button.

As seen in FIG. 6, decocking button 90 has surface 94 and leg 92. Leg 92 is shaped with curvature to cooperate with the rotation of striker locking guide 30 against it.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An internal locking mechanism for firearms having an enclosed striker assembly, comprising:

A) a striker locking guide having first and second ends, between said first and second ends, there are first and second longitudinal channels, said first end including a first recess, said first longitudinal channel extending from a first predetermined distance from said first end towards said second end a second predetermined distance without reaching said second end, said first longitudinal channel having third and fourth ends, and including a first notch extending a third predetermined distance from said third end towards said fourth end a fourth predetermined distance, said second longitudinal channel extending from a fifth predetermined distance from said first end towards said second end a sixth predetermined distance without reaching said second end, said second longitudinal channel having fifth and sixth ends, includes a second and third notch, said second notch extending a seventh predetermined distance from said fifth end towards said sixth end without reaching said sixth end, said third notch extending an eighth predetermined distance from said second notch to said sixth end a ninth predetermined distance, said second end having a fourth notch;

B) a firing pin assembly having a shaft with seventh and eighth ends, said shaft having a first leg extending radially outwardly a tenth predetermined distance and a second leg extending radially outwardly an eleventh predetermined distance, said seventh end including a firing pin, said firing pin assembly further includes a stopper surface mounted at a twelfth predetermined distance from said seventh end without reaching said eighth end and a spring member partially housing said shaft, said spring member includes ninth and tenth ends, said ninth end coacts against said second end that in turn coacts with said first and second legs, keeping said spring biased towards said second end, said second end having cooperative dimensions to coact with said spring and selectively causing said spring member to compress against said stopper surface;

C) a key plate assembly having inner and outer walls, said key plate assembly having a first through opening, said inner wall including a second recess with mating cooperative characteristics to receive said first end of said striker locking guide; and D) rotational means for rotating said striker locking guide through said first through opening so that said first and second legs are selectively brought in alignment with said first and third notches respectively, thereby restricting the travel of said shaft, and in alignment with said first and second longitudinal channels respectively having unobstructed travel that permits the operation of said firearm.

2. The internal locking mechanism for firearms having an enclosed striker assembly set forth in claim 1, wherein said rotational means includes a key, insertable through said first through opening of said key plate assembly to said first recess so that a user exerting a rotational force, rotates said striker locking guide selectively from an unlocked position to a locked position and vice-a-versa.

3. The internal locking mechanism for firearms having an enclosed striker assembly set forth in claim 2, wherein said first end of said striker locking guide has at least one indicating mark.

4. The internal locking mechanism for firearms having an enclosed striker assembly set forth in claim 3, wherein said key plate assembly has a second through opening to allow for visual identification of said indicating mark.

5. The internal locking mechanism for firearms having an enclosed striker assembly set forth in claim 4, wherein said second recess has at least one protrusion axially mounted thereon having mating cooperative characteristics with said first recess to provide notice when said user rotates said striker locking guide selectively from an unlocked position to a locked position and vice-a-versa.

6. The internal locking mechanism for firearms having an enclosed striker assembly set forth in claim 5, wherein said indicating mark is self-illuminating.

* * * * *